US008567830B2

(12) United States Patent
Liang et al.

(10) Patent No.: US 8,567,830 B2
(45) Date of Patent: Oct. 29, 2013

(54) AUTO CAM LOCK

(75) Inventors: Luke Liang, South Plainfield, NJ (US); David Chen, Guangzhou (CN)

(73) Assignee: Vision Industries Group, Inc., So. Plainfield, NJ (US)

( * ) Notice: Subject to any disclaimer, the term of this patent is extended or adjusted under 35 U.S.C. 154(b) by 435 days.

(21) Appl. No.: 12/813,676

(22) Filed: Jun. 11, 2010

(65) Prior Publication Data

US 2011/0304163 A1 Dec. 15, 2011

(51) Int. Cl.

| | |
|---|---|
| ***E05C 3/02*** | (2006.01) |
| *E05C 5/00* | (2006.01) |
| *E05C 19/12* | (2006.01) |
| *E05B 3/00* | (2006.01) |

(52) U.S. Cl.
USPC . 292/240; 292/111; 292/336.3; 292/DIG. 20; 292/DIG. 47

(58) Field of Classification Search
USPC ..... 292/163, DIG. 7, 242, DIG. 47
See application file for complete search history.

(56) References Cited

U.S. PATENT DOCUMENTS

| | | | | |
|---|---|---|---|---|
| 4,063,766 | A * | 12/1977 | Granberg | 292/336 |
| 5,219,193 | A * | 6/1993 | Piltingsrud | 292/240 |
| 7,017,957 | B2 * | 3/2006 | Murphy et al. | 292/241 |
| 7,070,215 | B2 * | 7/2006 | Kelley et al. | 292/241 |
| 7,159,908 | B2 * | 1/2007 | Liang | 292/242 |
| 7,407,199 | B2 | 8/2008 | Richardson | |
| 7,591,494 | B2 * | 9/2009 | Mitchell | 292/336 |
| 7,699,365 | B2 * | 4/2010 | Liang et al. | 292/240 |
| 7,922,223 | B2 * | 4/2011 | Lawrence | 292/241 |
| 8,002,317 | B2 * | 8/2011 | Satram et al. | 292/336 |
| 8,205,920 | B2 * | 6/2012 | Flory | 292/241 |
| 8,272,164 | B2 * | 9/2012 | Albrecht | 49/185 |
| 2001/0005995 | A1 * | 7/2001 | Subliskey | 70/89 |
| 2008/0012357 | A1 | 1/2008 | Liang | |
| 2009/0115204 | A1 * | 5/2009 | Rycroft | 292/341.17 |

* cited by examiner

*Primary Examiner* — Kristina R Fulton
*Assistant Examiner* — Faria Ahmad
(74) *Attorney, Agent, or Firm* — Thomas A. O'Rourke; Bodner & O'Rourke, LLP

(57) ABSTRACT

An auto cam lock is disclosed here. The disclosed auto cam lock comprises a lock housing assembled with a cam and an actuator; a cam adapted to rotate between an extending position and a retracted position, the cam being adapted to be engaged with and retained by the lock housing when the cam is in the retracted position; a cam resilient means for giving the cam a resilient force adapted to drive the cam to rotate from the retracted position to the extending position; an actuator operatively coupled with the cam, said actuator being adapted to move between an extending position and a retracted position, and said the actuator being adapted to release the cam from the cam's retracted position retained by the lock housing when the actuator moves from the actuator's extending position to the actuator's retracted position; and an actuator resilient means for giving the actuator a resilient force adapted to drive the actuator to move from the retracted position to the extending position.

20 Claims, 19 Drawing Sheets

AUTO CAM LOCK

TECHNICAL FIELD

The present invention relates to windows, and more specifically, to cam latching mechanisms for windows.

BACKGROUND OF INVENTION

Double hung and other sliding sash type windows are very common. Typically, a latch or locking mechanism is used to secure the sashes in place to inhibit unintentional opening of the sashes and unauthorized entry to the structure.

One very common mechanism used to lock sashes together is the so-called check rail lock, which includes a sweep cam attached to a rotatable handle. The check rail lock is mounted on one of the sashes, usually the lower sash of a double-hung window proximate the center of the sash rail. A keeper structure is mounted on the other sash proximate the check rail lock. As the handle is rotated in either direction, the sweep cam is rotated into or out of engagement with the keeper in order to enable locking or opening of the window as desired. A drawback of these devices, however, is that the handle can be rotated so that the sweep cam is extended even when the sash is open. When the sash is closed with the sweep cam in such position, the extended position of the sweep cam prevents full closure of the sash. The operator of the window may not notice the window is not fully closed and latched. In addition, the sweep cam may strike and damage the other sash.

Another prior mechanism includes a sliding latch bolt that may be mounted on one sash and that is selectively engageable with a keeper mounted on the other sash. A drawback with these mechanisms, however, is often that the bolt must be held in a retracted position as the window is operated. In other case, where a mechanism for holding the bolt in a retracted position is employed, the bolt either releases as soon as the window is raised, or must be manually released with a separate catch or button. In such cases, the window may fail to close fully and may not be noticed by the operator of the window.

Some prior mechanisms have tried to solve the above problems, but the solutions focus on bolt latch. What is still needed is a simple and comfortable cam latch mechanism for a window that automatically latches when the window is returned to a closed position.

SUMMARY OF THE INVENTION

The present invention addresses the need of the industry for a simple and comfortable cam lock that automatically latches a window when the window is returned to a closed position. According to an embodiment of the invention, a window is equipped with an auto cam lock having a cam and a spring driven actuating mechanism in the housing of the window lock. The auto cam lock is mounted on a sash of a window assembly opposite a keeper or similar cam latch receiving structure. With the window in a closed position, the cam latch is received in the keeper to latch the sashes together, and the actuating mechanism is confined in a retracted position by the keeper. To open the window, the cam latch is disengaged from the keeper by rotating a handle and pulling outwardly away from keeper. The cam latch slides out of the keeper and goes into the housing, and the actuating mechanism is released by the keeper and extends outwardly from the housing and reaches an extended position. The cam latch is held in a retracted position by a stopping mechanism in the housing of the lock. With the cam latch in this position, the sash may be moved to open the window. To close the window, the sash with the auto cam lock is moved toward the keeper. The outwardly extending portion of the actuating mechanism contacts the keeper that pushes the actuating mechanism inwardly into the housing. The actuating mechanism actuates the cam latch and disengages the cam latch from the stopping mechanism. A spring urges the cam latch forwardly so that it is once again engaged in the keeper and the sashes are latched together as before.

According to one embodiment, a cam lock for a window includes a lock; a cam adapted to rotate between an extending position and a retracted position; a cam resilient means for giving the cam a resilient force adapted to drive the cam to rotate from the retracted position to the extending position; an actuator operatively coupled with the cam; and an actuator resilient means for giving the actuator a resilient force adapted to drive the actuator to move from the retracted position to the extending position.

Embodiments of the housing of the latch mechanism may include a top cover and a bottom cover. A hook mechanism and a post-hole mechanism are coupled with the top cover and the bottom cover. The top and the bottom covers can be held together in two steps. The first step is that the post-hole mechanism holds the top cover and the bottom cover together when the hook mechanism does not hold the top cover and the bottom cover. The second step is that the hook mechanism holds the top cover and the bottom cover together with the post-hole mechanism.

The advantage of this invention is a simple and comfortable solution for manufacturers and consumers to manufacture, assemble, install, and use an automatic cam latch for a window.

DETAILED DESCRIPTION OF THE INVENTION

Figure 1:
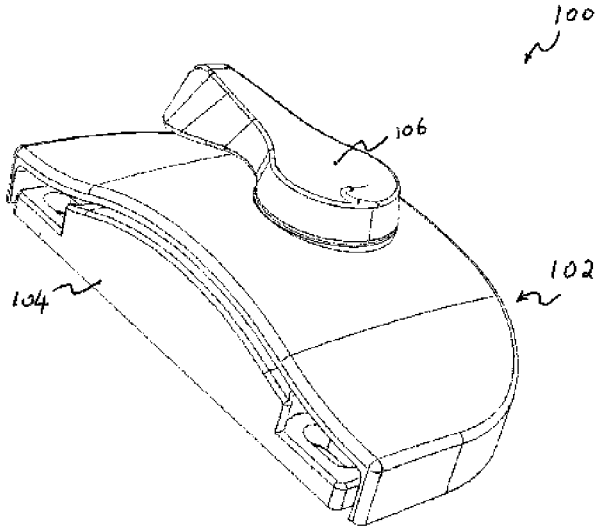
FIG. 1 depicts one exemplary embodiment of the disclosed art.
Figure 2:
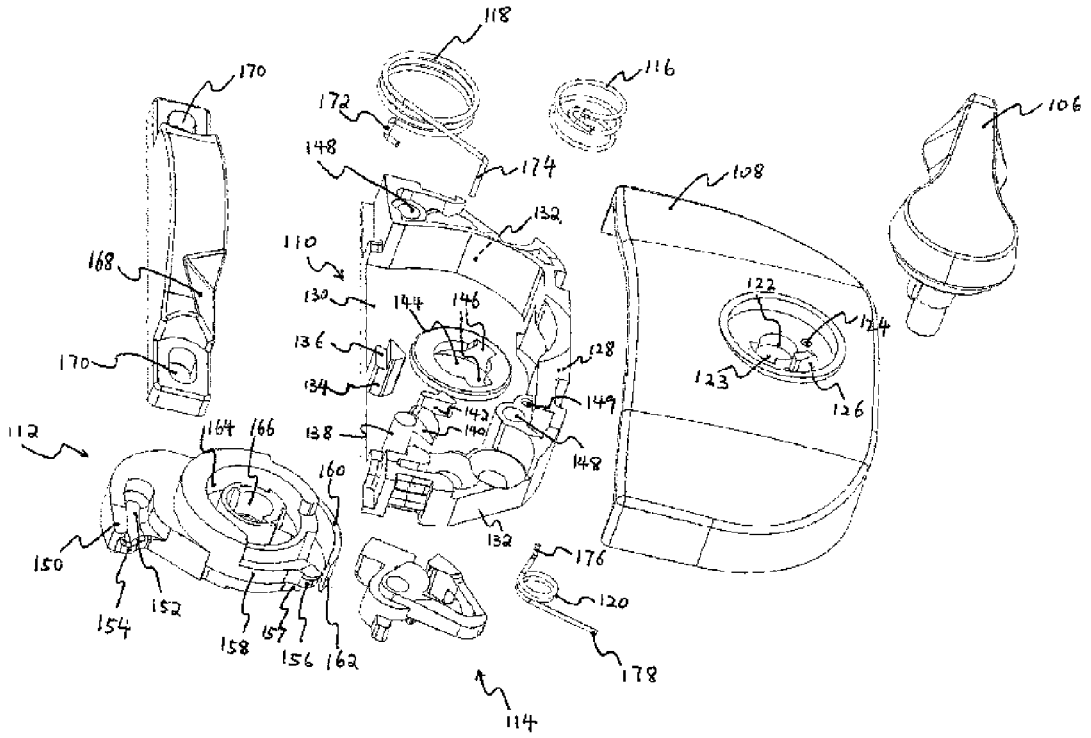
FIG. 2 is a top exploded view of the exemplary embodiment in FIG. 1.
Figure 3:
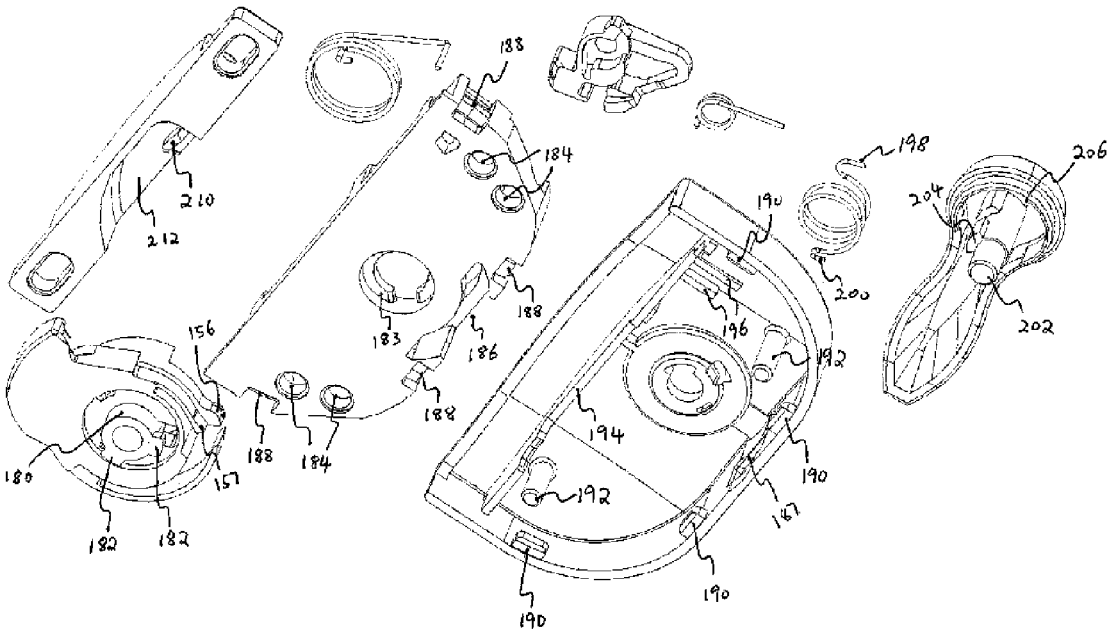
FIG. 3 is a bottom exploded view of the exemplary embodiment in FIG. 1.

FIG. 1 is one exemplary embodiment of the disclosed art. FIG. 2 is a top exploded view of the exemplary embodiment in FIG. 1. FIG. 3 is a bottom exploded view of the exemplary embodiment in FIG. 1. Auto cam lock 100 in FIG. 1 includes lock housing 102, cam receiver 104, and handle 106 (shown in FIG. 1). Lock housing 102 includes top cover 108 and base cover 110. In lock housing 102, there are further cam 112, actuator 114, cam spring 118, and actuator spring 120. Between handle 106 and top cover 108, there is handle spring 116. Those skilled in the art will realize and understand, upon reading this description, that resilient elements other or different than springs may be used to fulfill the same function.

Top cover 108 further includes top cover shaft hole 122, top cover shaft hole breach 123, top cover spring hole 124, and an one-way pass element that can be resilient lobe 126. Top cover 108 further includes four top cover hooks 190, a pair of top cover post 192, top cover front wall 194, housing indicator window 187, and actuator fixing beam 196.

Base cover 110 includes rear wall 128, bottom wall 130, and a pair of side walls 132. Base cover 110 further includes base projection 140, a cam stop element that can be base stop post 134, base stop post stair 136, base actuator post 138, base cam stop pin 142, base cam hole 144, base cam spring hole 149, a pair of base cam hole breaches 146, and a pair of base cover holes 148. Base cover 110 further includes four base cover screw holes 184, base indicator window 186, cam hole edge 183, and four base cover hooks 188 (shown in FIG. 3).

Cam 112 includes cam latch 150, cam groove 152, cam stop wall 154, cam actuate pin 156, can stop pin 157, cam stop pin arm 158, cam indicator arm 160, cam indicator 162, cam spring slot 164, and cam handle hole 166. Cam 112 further includes cam shaft 180 and a pair of cam shaft projections 182 (shown in FIG. 3).

Cam receiver 104 includes receiver bevel wall 168 and a pair of receiver screw hole 170. Cam receiver 104 further includes receiver keeper 210 and receiver guide slot 212 (shown in FIG. 3).

Figure 5:
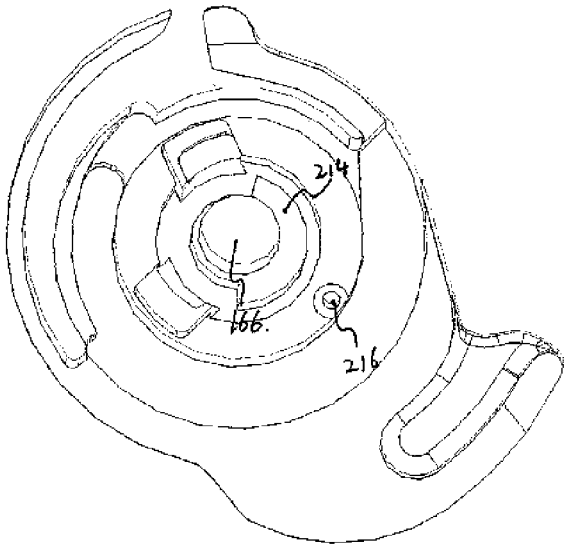
FIG. 5 is a top detailed view of the cam in exemplary embodiment in FIG. 1.
Figure 6:
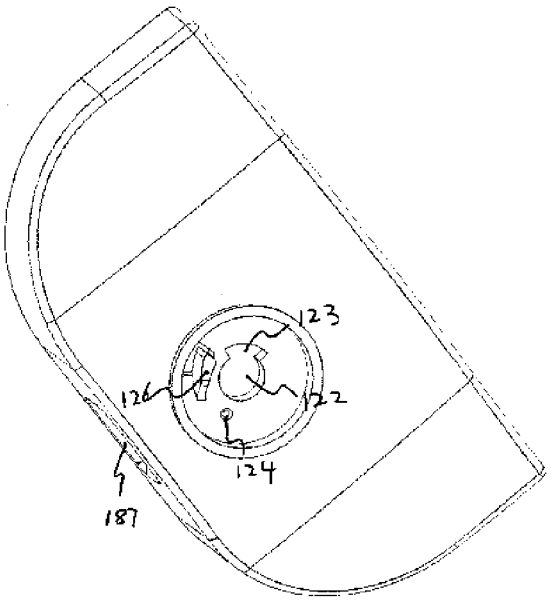
FIG. 6 is a top detailed view of the top cover in exemplary embodiment in FIG. 1.

Cam spring 118 includes cam spring cam hook 172 and cam spring base hook 174. Actuator spring 120 includes actuator spring actuator hook 176 and actuator spring extension 178. Handle spring 116 includes handle spring handle hook 198 and handle spring cover hook 200 (shown in FIG. 3). FIG. 5 is a top detailed view of the cam in exemplary embodiment in FIG. 1. Cam 112 further includes handle guide slot 214 and cam spring hole 216.

Figure 4:
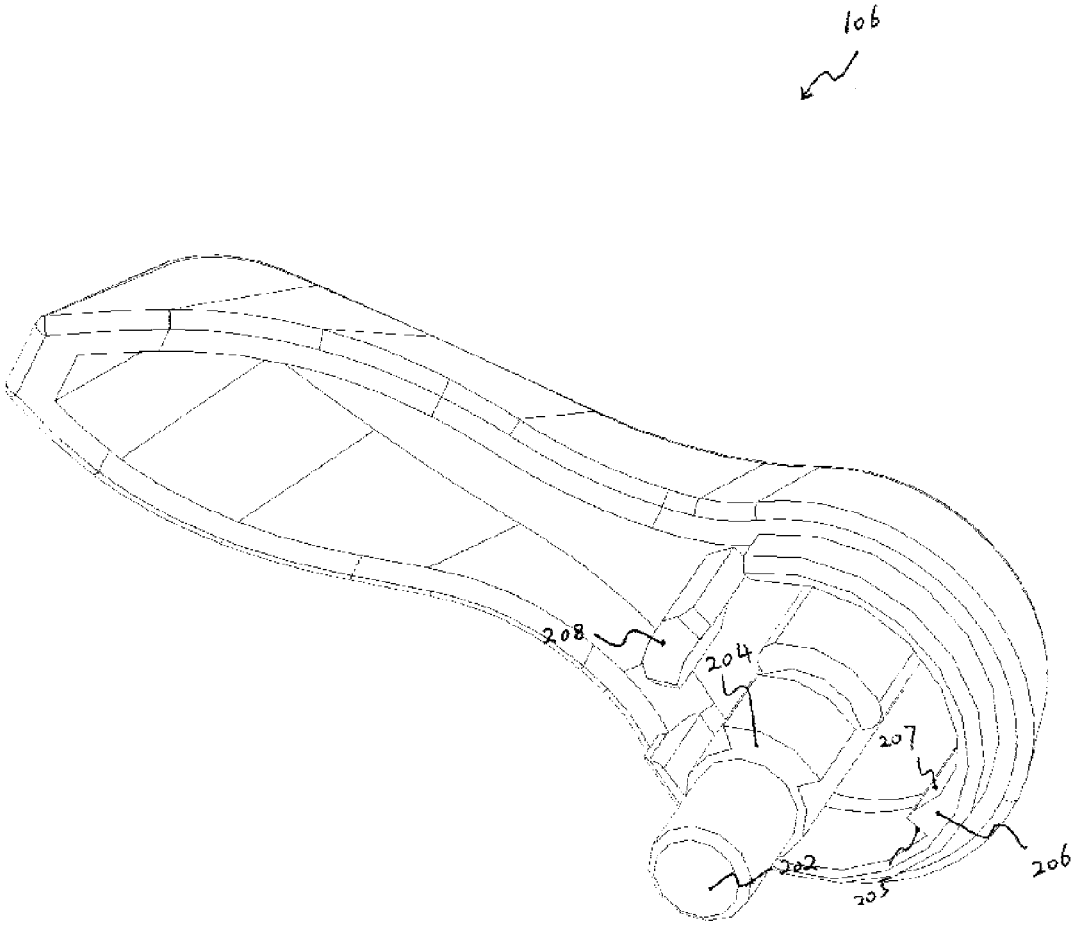
FIG. 4 is a bottom detailed view of the handle in exemplary embodiment in FIG. 1.

FIG. 4 is a bottom detailed view of the handle in exemplary embodiment in FIG. 1. Handle 106 includes handle shaft 202, handle shaft projection 204, handle stop 206, hand stop bevel side 207, handle stop wall 205, and handle spring tab 208.

Figure 7:
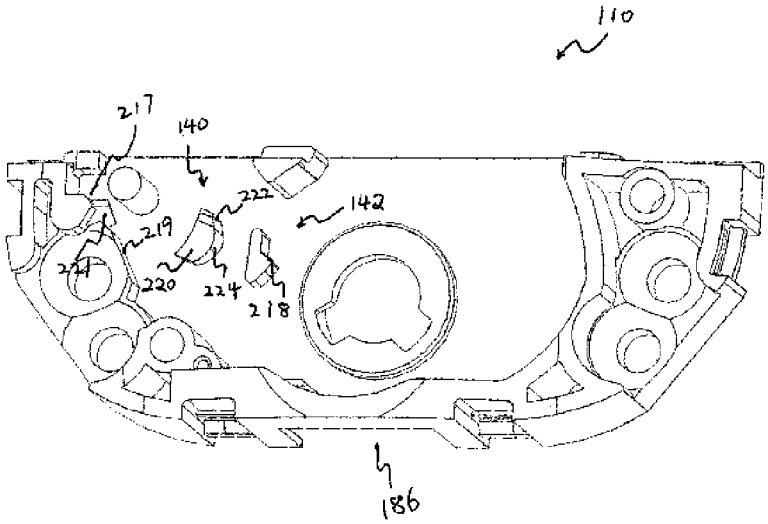
FIG. 7 is a detailed view of the mechanism on the base over of exemplary embodiment in FIG. 1.

FIG. 7 is a detailed view of the mechanism on the base over of exemplary embodiment in FIG. 1. Base cam stop pin 142 on base cover 110 further includes base cam stop point 218. Base projection 140 on base cover 110 further includes base slide chamfer 220, block wall 222, and arc side 224. Base cover 110 further includes actuator spring stop wall 219, actuator stop wall 221, and an actuator stop element that can be actuator stop slot 217.

Figure 8:
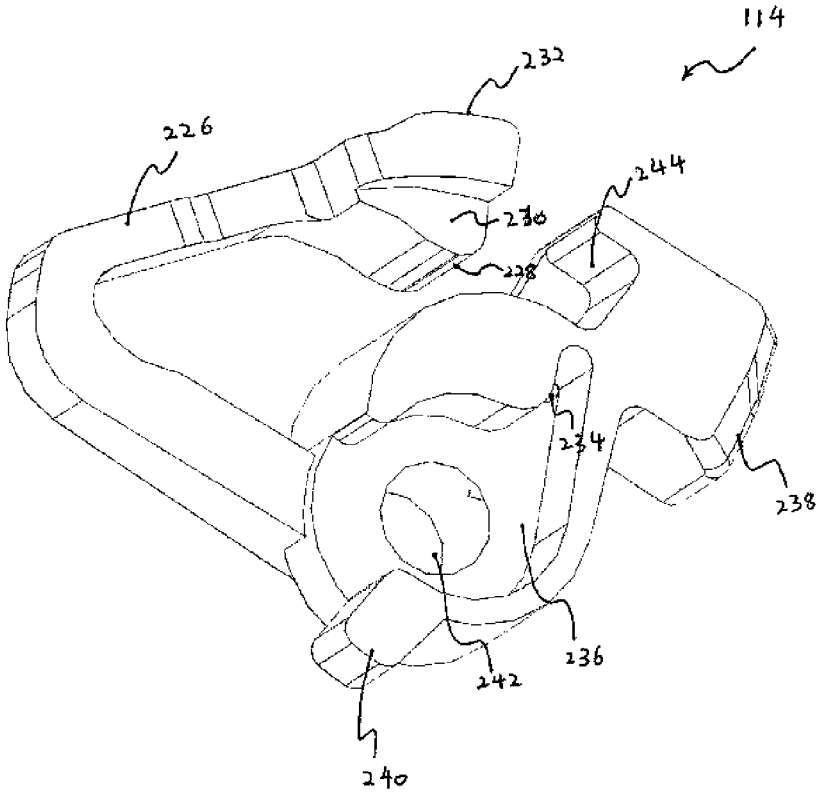
FIG. 8 is a bottom detailed view of the actuator of exemplary embodiment in FIG. 1.
Figure 9:
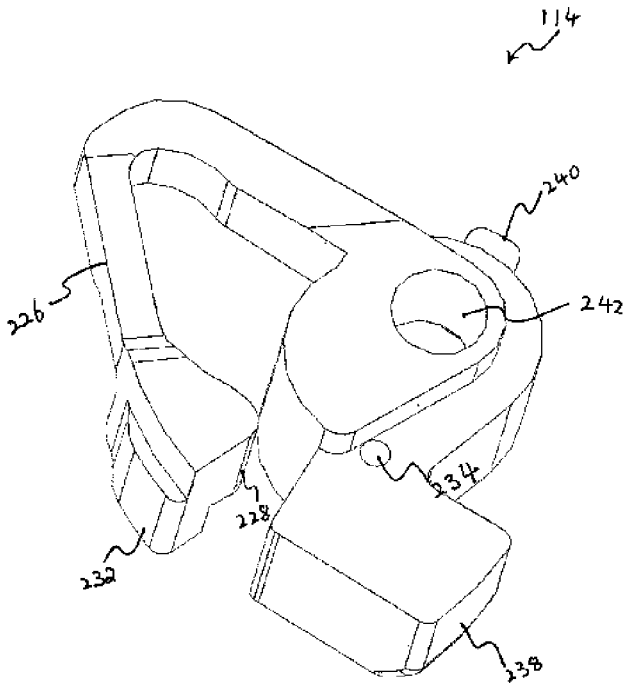
FIG. 9 is a top detailed view of the actuator of exemplary embodiment in FIG. 1.

FIG. 8 is a bottom detailed view of the actuator of exemplary embodiment in FIG. 1. Actuator 114 further includes actuator arm 226, actuator block point 228, actuator slide chamfer 230, and actuate point 232. These elements can also be seen from FIG. 9 from a different perspective. Actuator 114 further includes actuator spring hole 234, actuator spring slot 236, actuator tongue 238, actuator stop point 240, actuator post hole 242, and actuator bottom slot 244. Those skilled in the art will realize and understand, upon reading this description, that other and or different elements may be included to fulfill the same function.

Figure 10:
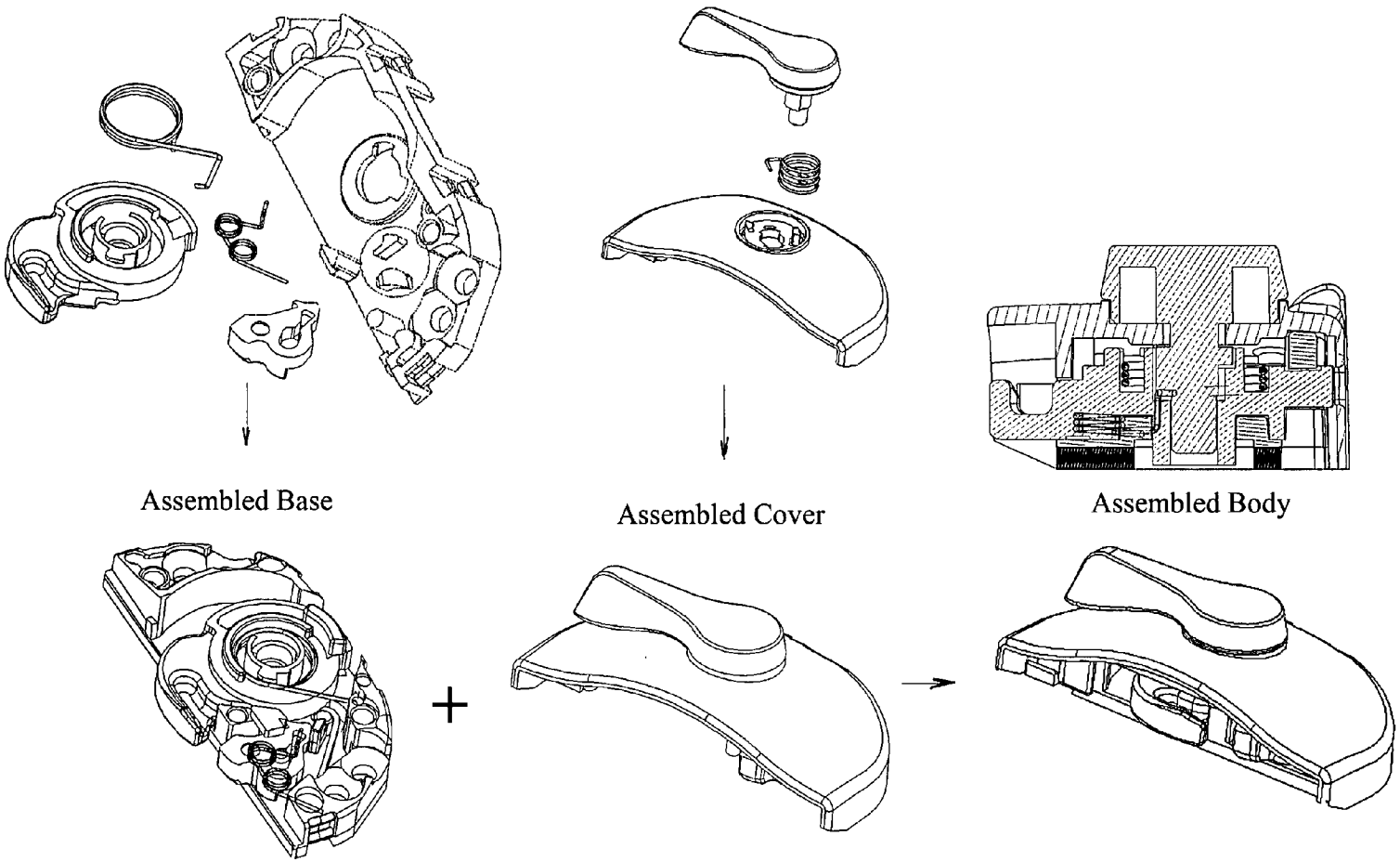
FIG. 10 shows an exemplary assembly process of the disclosed auto cam lock.

One exemplary assembly process is shown in FIG. 10. The exemplary assembly process generally includes the flowing steps. Cam spring 118 is mounted in cam spring slot 164, wherein cam spring cam hook 172 grips cam 112 through cam spring hole 216 and wherein cam spring base hook 174 is inserted into base cam spring hole 149. Cam 112 is mounted on base cover 110, wherein cam shaft 180 goes through base cam hole 144 and wherein cam shaft projections 182 go through base cam hole breaches 146. The mounted cam spring 118 is in a pre-tight state that gives cam 112 a counterclockwise torque (from the top view). This counterclockwise torque rotates cam 112 until cam stop wall 154 pushes against base stop post 134. This rotation also makes cam shaft projections 182 move away from base cam hole breaches 146 after cam shaft projections 182 go through base cam hole breaches 146. Thus, cam shaft projections 182 hold cam 112 on cam hole edge 183. Actuator spring 120 is mounted into actuator spring slot 236, wherein actuator spring actuator hook 176 grips actuator 114 through actuator spring hole 234. Actuator spring extension 178 pushes against actuator spring stop wall 219. Actuator 114 is mounted on base cover 110, wherein base actuator post 138 goes through actuator post hole 242 and wherein actuator stop point 240 goes through actuator stop slot 217. Actuator spring 120 is in a pre-tight state that gives actuator 114 a counterclockwise torque (from the top view). This counterclockwise torque rotates actuator 114 until actuator stop point 240 pushes against actuator stop wall 221. These steps lead to an assembled base shown in FIG. 10.

Figure 11:
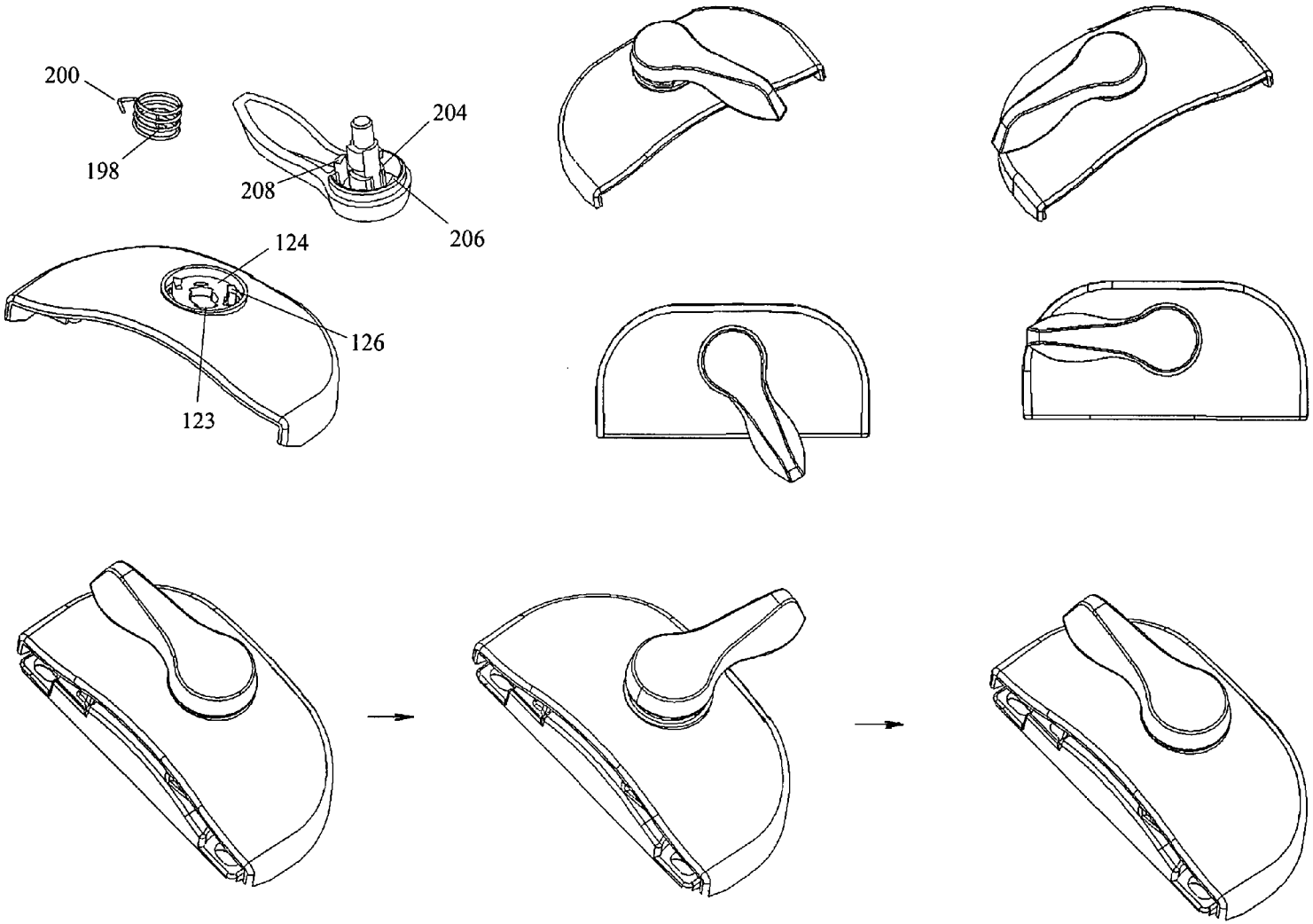
FIG. 11 shows an exemplary assembly process and moving process of the assembly cover of the auto cam lock.

Handle spring 116 is mounted on top cover 108, wherein handle spring cover hook grips top cover 108 by going through top cover spring hole 124. Handle spring handle hook 198 grips handle spring tab 208. Handle 106 is pushed toward top cover 108 wherein handle shaft 202 goes through top cover shaft hole 122 and wherein handle shaft projection 204 goes through top cover shaft hole breach 123. After handle shaft projection 204 goes through top cover shaft hole breach 123, handle 106 is rotated in clockwise, wherein handle shaft projection 204 moves away from top cover shaft hole breach 123, and wherein handle stop 206 passes resilient lobe 126. Handle shaft projection 204 moves away from top cover shaft hole breach 123 so that handle shaft projection 204 can hole handle 106 on top cover 108. Handle stop 206 can pass resilient lobe 126 because resilient lobe 126 is pushed centripetally by handle stop 206 and slides on handle stop 206 along handle stop bevel side 207. Once handle stop 206 passes resilient lobe 126, it cannot pass back since resilient lobe 126 resumes to its original position and blocks handle stop wall 205. Handle spring 116 is in a pre-tight state that gives handle 106 a counterclockwise torque, and handle 106 is rotated until handle stop 206 pushes against resilient lobe 126. These steps are shown in FIG. 11, and these steps lead to assembled cover shown in FIG. 10.

Figure 12:
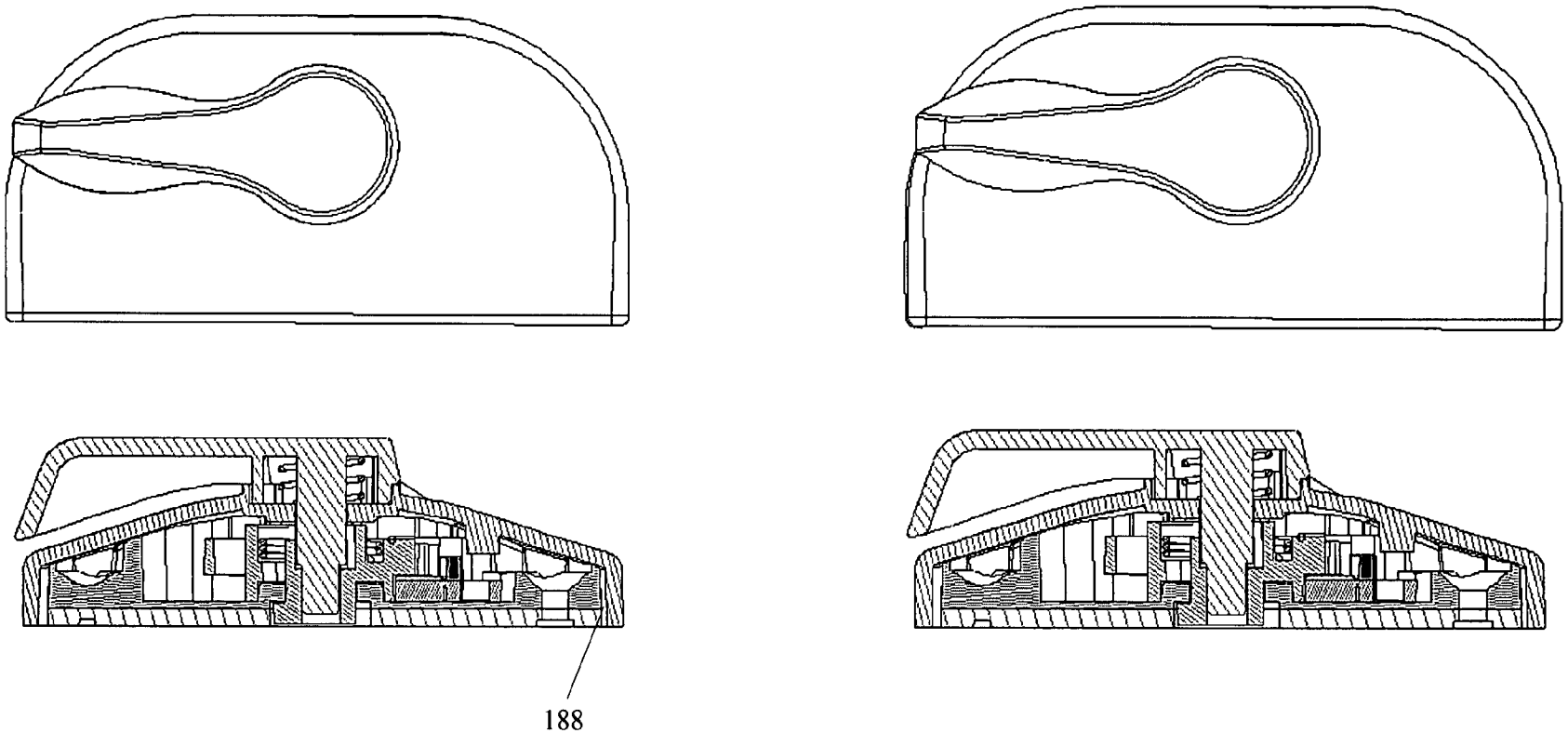
FIG. 12 shows the semi-assembled state and the final-assembled state of the lock.

The assembled cover is further mounted on the assembled base. Handle shaft 202 goes through cam handle hole 166. Handle shaft projection 204 goes into handle guide slot 214. Handle guide slot 214 is fan-shaped with two straight sides. Handle shaft projection 204 is adapted to move from one straight side to the other straight side when handle 106 rotates relatively to cam 112. Top cover posts are pushed into base cover holes 148. The lock body has two assembled states: semi-assembled state and final assemble state. In semi-assembled state, top cover hooks 190 rest on base cover hooks 188. In final assembled state, top cover hooks 190 are further pushed downward and top cover hooks 190 and base cover hooks 188 hold together. The assembled cover is relatively easy to be moved from the assembled base in semi-assembled state. Semi-assembled state is delivered from lock manufactures to window manufacturers for the purpose of mounting locks on windows. The assembled cover needs to be removed since screw holes 184 are on base cover 110. When the lock is mounted on the window, window manufacturers can further push the assembled cover down to the final assembled state. In final assembled state, the assembled cover is relatively difficult to be moved from the assembled base. The semi-assembled state and the final assembled state are shown in FIG. 12. The assembled body of auto cam lock 100 is shown in FIG. 10. In the final assembled state, actuator fixing beam 196 pushes against actuator 114, and thus keeps actuator 114 in a proper position during its action process. Those skilled in the art will realize and understand, upon reading this description, that other and or different assemble processes may be used to fulfill the same function.

Figures 13A, 13B, 13C, 13D:
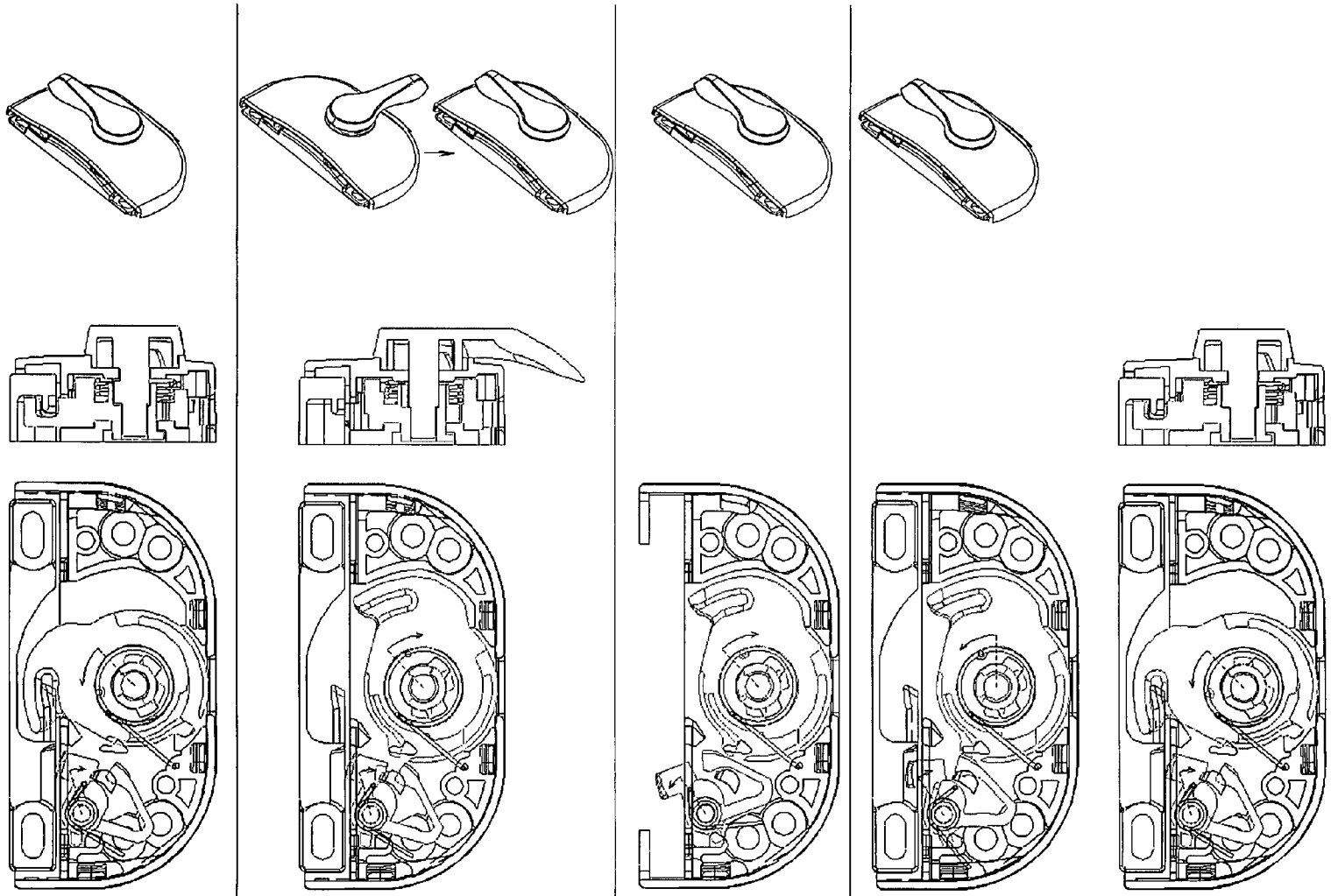
FIG. 13 A-D show the action process of the lock.
Figure 14A:
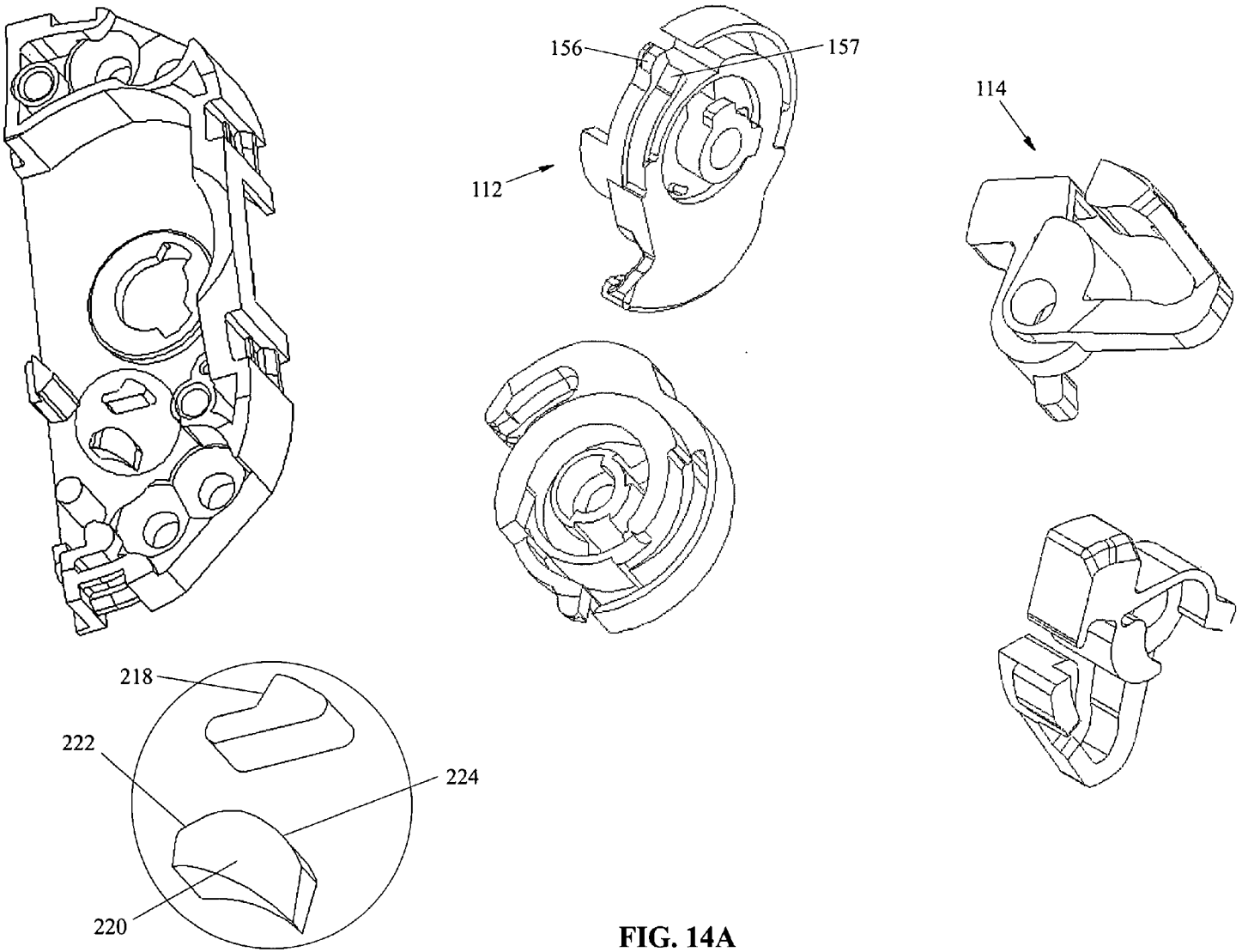
FIG. 14 A-E show the detailed action process of the lock.
Figure 14B:
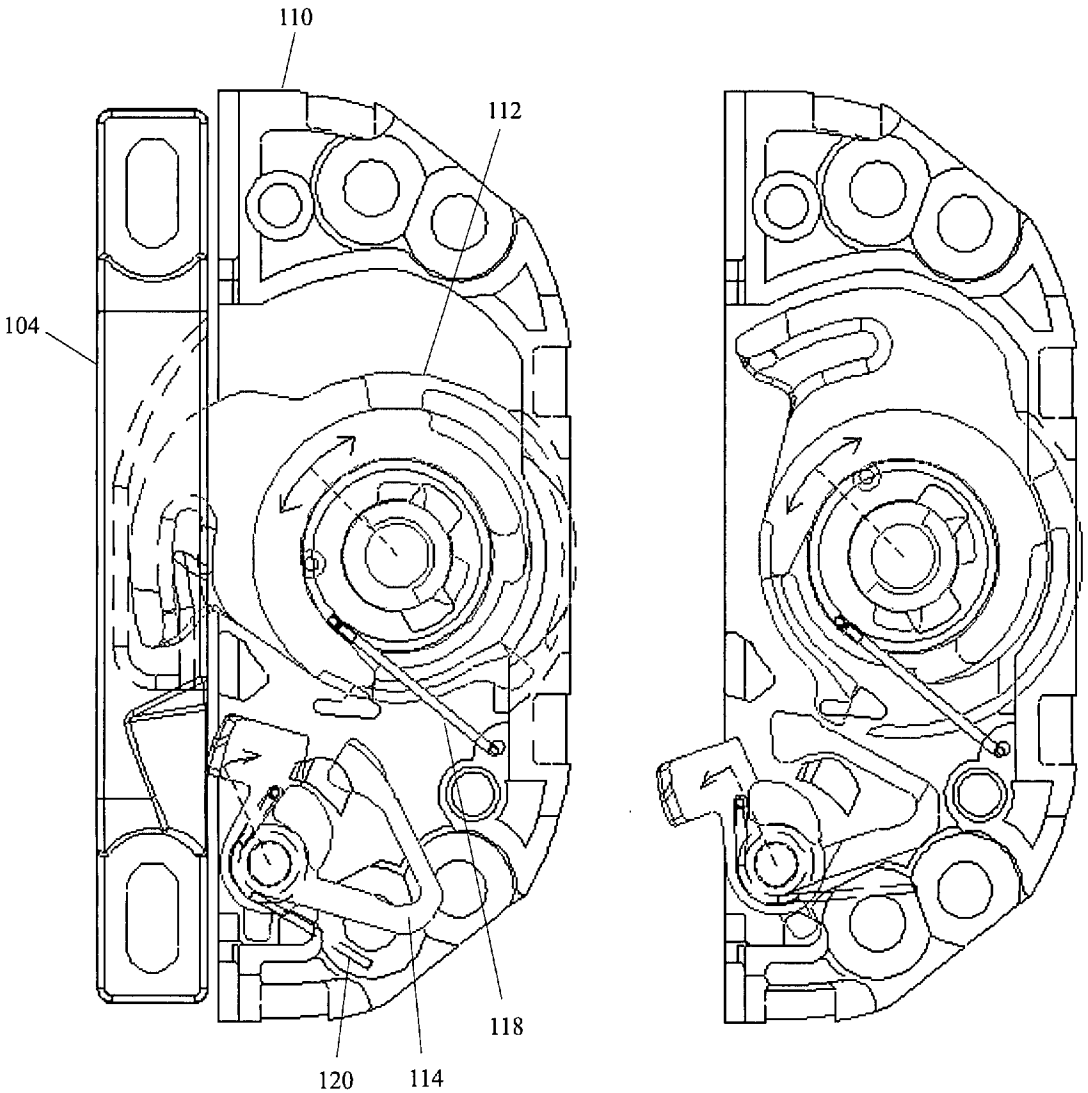
Figure 14C:
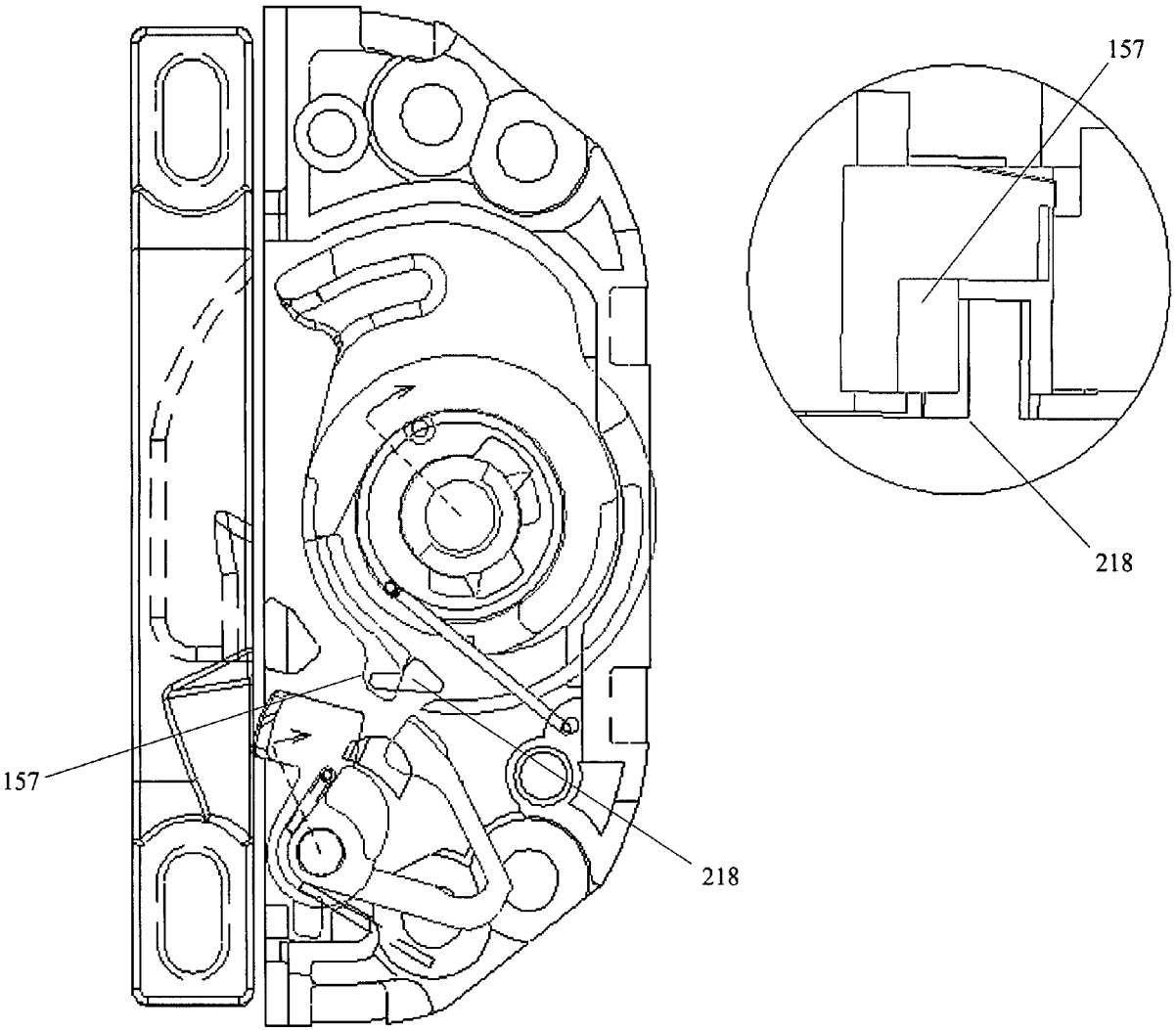
Figure 14D:
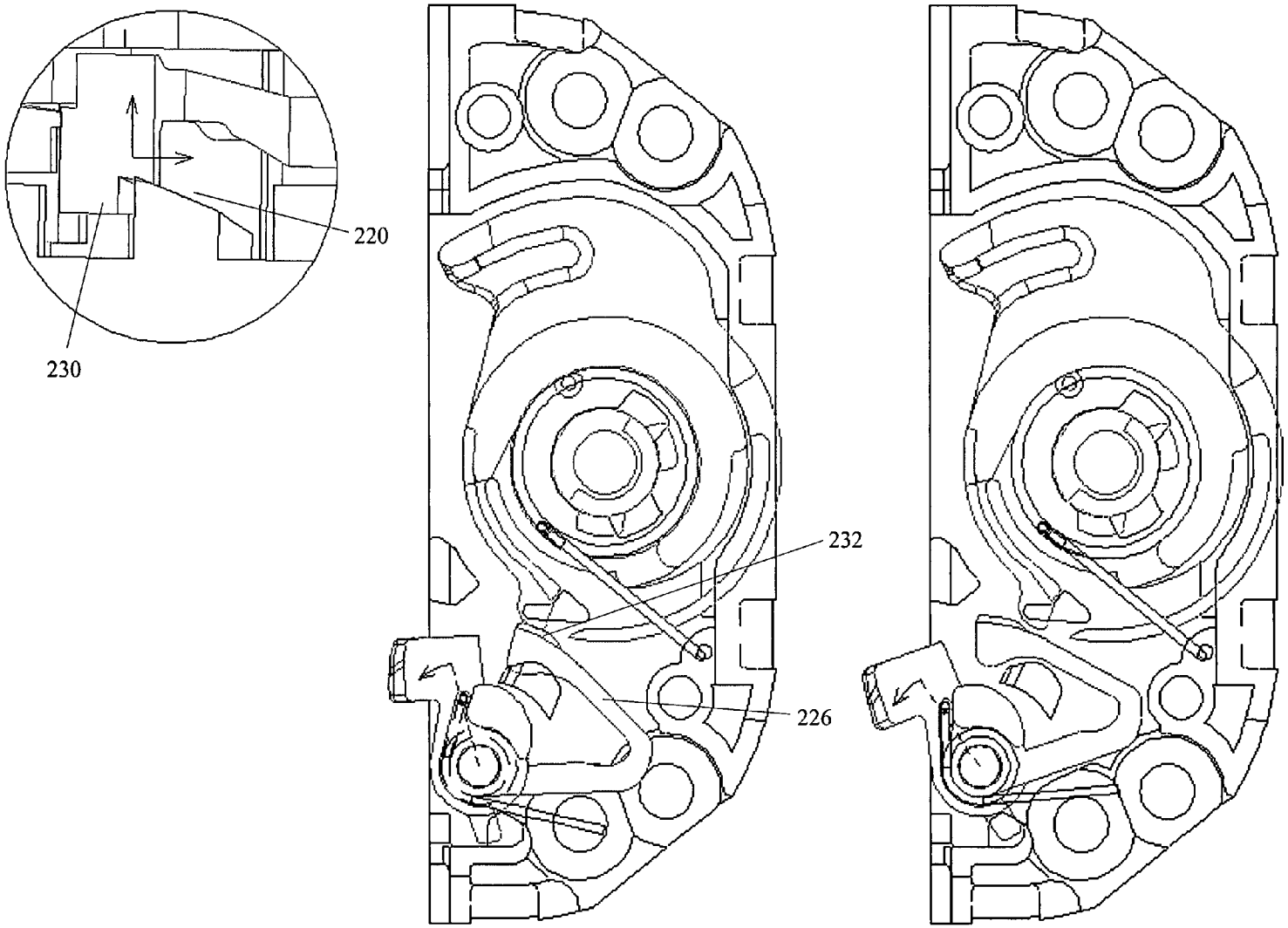
Figure 14E:
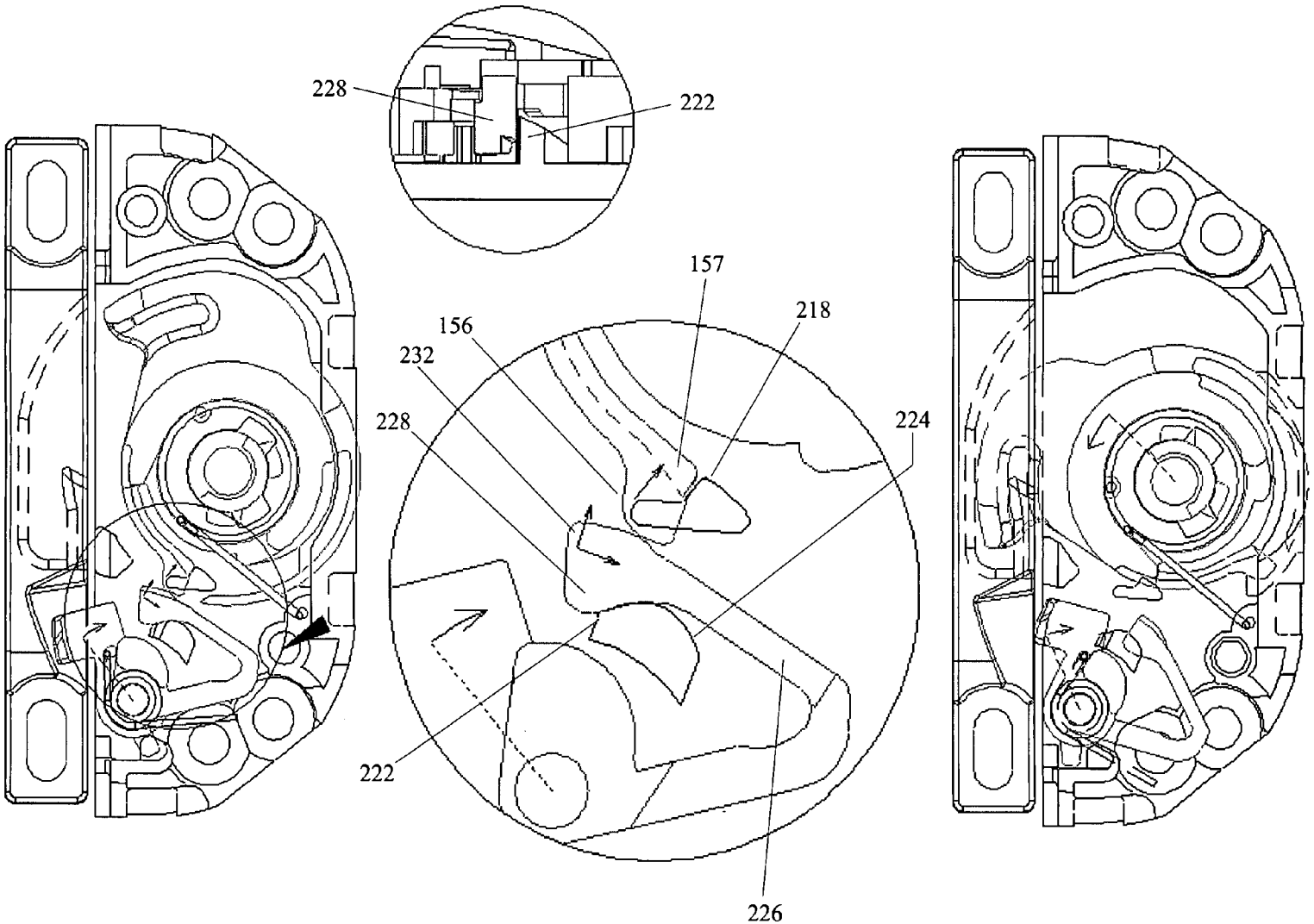

FIG. 13 A-D show the action process of the lock. FIG. 13-A depicts the lock state of auto cam lock 100. The following elements can be found in FIG. 2 and FIG. 3. Cam latch 150 rotates out of lock housing 102 into cam receiver 104. Receiver keeper 210 goes into cam groove 152. Thus, cam 112 is held by cam receiver 104. Actuator 114 is in a retracted position in lock housing 102, wherein receiver bevel wall 168 pushes against actuator tongue 238.

FIG. 13-B depicts the unlock process of auto cam lock 100. Handle 106 rotates clockwise (from the top view). Handle shaft projection 204 pushes one side of handle guide slot 214 (shown in FIG. 5), which rotates cam 112 clockwise (from the top view). Cam latch 150 rotates out of cam receiver 104 and into lock housing 102. Before the assembled body (shown in FIG. 10) clears cam receiver 104, actuator 114 is in a retracted position in lock housing 102 and receiver bevel wall 168 pushes against actuator tongue 238. Handle 106 rotates back counterclockwise to its initial position under the torque given by handle spring 116.

FIG. 13-C depicts the open state of auto cam lock 100. Cam stop pin 157 is held by base cam stop point 218. Thus cam 112 is kept in the retracted position. The assembled body clears cam receiver 104. Without being pushed by receiver bevel wall 168, actuator 114 extends out of lock housing 102 under the torque given by actuator spring 120.

FIG. 13-D depicts the lock process of auto cam lock 100. When the assembled body contacts cam receiver 104, receiver bevel wall 168 pushes against actuator tongue 238. Actuator 114 is back to the retracted position in lock housing 102. In this process, actuate point 232 pushes cam actuate pin 156. Cam stop pin 157 is released from base cam stop point 218. Cam 112, under the resilient torque given by cam spring 118, rotates counterclockwise (from the top view) from lock housing 102. Cam latch 150 rotates out of lock housing 102 into cam receiver 104. Receiver keeper 210 goes into cam groove 152. Auto cam lock 100 is locked as before.

FIG. 14 A-E show the detailed action process of auto cam lock 100. FIG. 14-A shows elements used in FIG. 14 C-E. These elements also exist in FIG. 2, FIG. 3, and FIG. 7-9. FIG. 14-B depicts the locked and unlocked states of auto cam lock 100. FIG. 14-C depicts the lock position of auto cam lock 100. Cam stop pin 157 is held by base cam stop point 218. Actuator slide chamfer 230 rests on base side chamfer 220.

FIG. 14-D depicts the unlock process of auto cam lock 100. Actuator 114 extends out of lock housing 102 under the torque given by actuator spring 120. During this process, actuator slide chamfer 230 slides counterclockwise (from a top view) along base slide chamfer 220. Since both actuator slide chamfer 230 and base slide chamfer 220 are bevel-shaped, actuator arm 226 is lifted upwardly in this process, and actuate point 232 does not touch cam actuate pin 156. After actuator 114 extends out of lock housing 102, actuator slide chamfer 230 clears base slide chamfer 220 and actuator arm 226 resumes its horizontal position.

FIG. 14-E depicts the lock process of auto cam lock 100. Receiver bevel wall 168 pushes against actuator tongue 238. When actuator 114 goes back to the retracted position in lock housing 102, actuator block point 228 contacts block wall 222 so that actuator slide chamfer 230 cannot slide onto base slide chamfer 220. Actuator block point 228 slides along arc slide 224. During this process, actuate point 232 is pushed centrifugally by base projection 140. Thus, actuate point 232 touches cam actuate pin 156 and releases cam stop pin 157 from base cam stop pin 142. Cam 112 is actuated and, under the resilient torque given by cam spring 118, rotates counterclockwise (from the top view) from lock housing 102. Auto cam lock 100 is locked as before. Those skilled in the art will realize and understand, upon reading this description, that other and or different actuating processes may be used to fulfill the same function.

Figure 15:
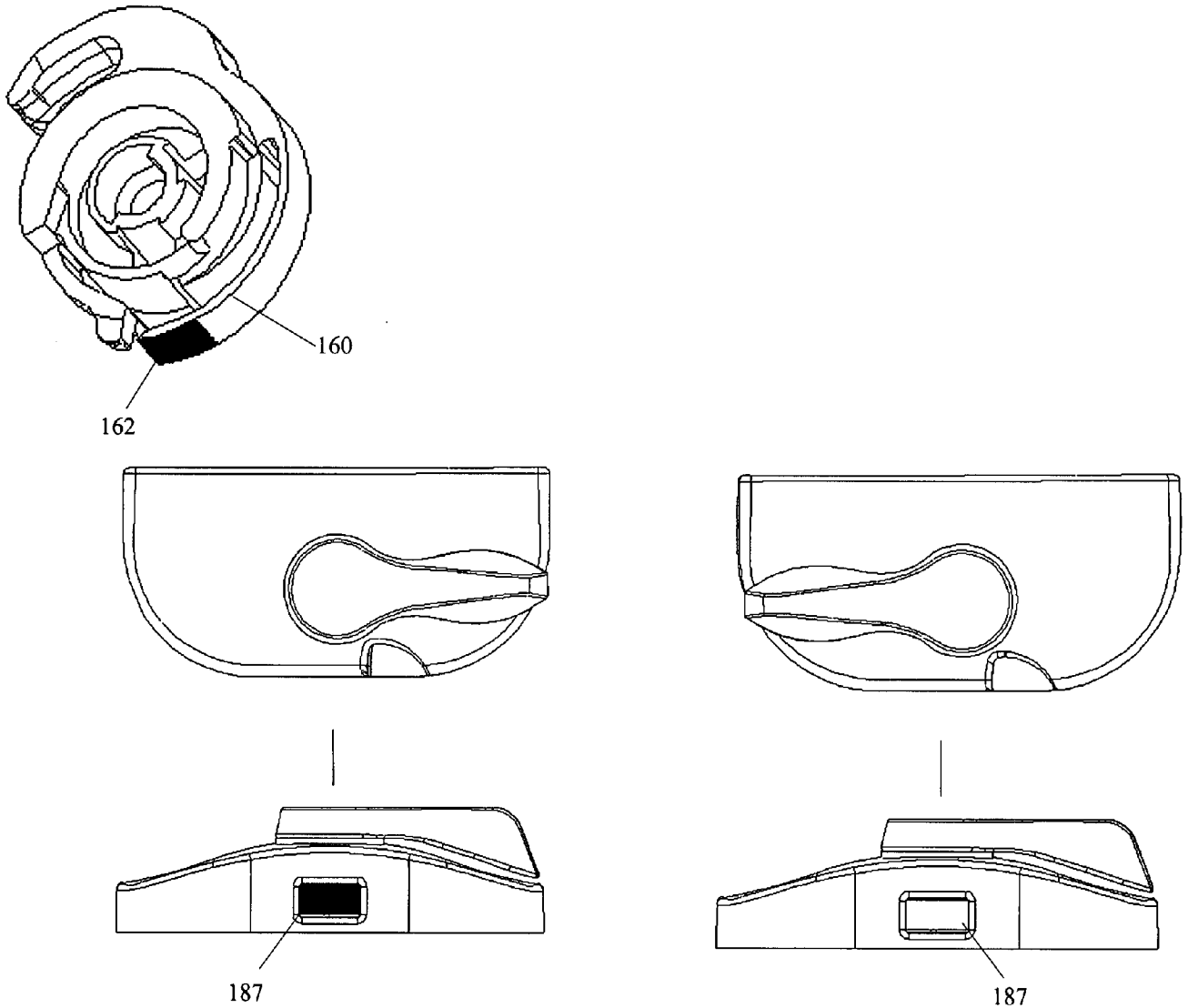
FIG. 15 shows the work process of the indicator.

FIG. 15 shows the work process of cam indicator 162. When top cover 108 is mounted on base cover 110, base indicator window 186 overlaps with housing indicator window 187. At one end of cam indicator arm 160, there is a cam indicator 162 that has a different color than other part of cam indicator arm 160. One exemplary color for cam indicator 162 is red, and the rest part of cam indicator arm 160 is white. When cam 112 extends out of lock housing 102, cam indicator 162 overlaps with housing indicator window 187, so cam indicator 162 cam be seen from outside. When cam 112 is in the retracted position, the other part of cam indicator arm 160 overlaps with housing indicator window 187. Therefore, the locked position and the unlocked position can be told from the color in housing indicator window 187 from outside. Those skilled in the art will realize and understand, upon reading this description, that other and or different indicating mechanisms may be used to fulfill the same function.

The disclosed art can have different embodiments with various screw holes. Multiple screw locations increase the adaptability of this latch mechanism to many window systems, including but not limited to, sliding window systems and double-hung window systems. Those skilled in the art will also realize and understand, upon reading this description, that other and or different screw locations may be used to adapt this latch mechanism to various window systems.

What is claimed is:

1. An auto cam lock, comprising:

a housing, said housing configured to mount to a sash window, said housing comprising a cavity, said housing comprising a base cam stop pin and a base projection protruding into said cavity;

a handle member, said handle member comprising a shaft configured to be pivotally received within a hole in said housing, said shaft comprising a projection configured to extend outward from said shaft into said housing cavity;

a cam, said cam configured to pivot about an axis within said housing cavity between a retracted position, and an extended position where a portion of said cam protrudes out from an opening in said housing, said cam comprising a groove in the top of said protruding portion, said cam comprising a hole concentric with said cam pivot axis, said hole configured to pivotally receive said shaft of said handle member, said cam comprising a handle guide slot in the top of said cam, being substantially concentric with said cam pivot axis, said handle guide slot configured to receive said projection of said shaft with said projection being movable therein, said cam thereby configured to be driven from the extended cam position to the retracted cam position by contact between said shaft projection and an end of said handle guide slot; said cam comprising a cam stop pin, an end of said cam stop pin configured to engage a side of said base cam stop pin to releasably retain said cam in the retracted cam position;

a cam resilient means, said cam resilient means configured to normally bias said cam to rotate from the retracted cam position to the extended cam position;

an actuator, said actuator configured to pivot about an axis within said housing cavity between a retracted position, and an extended position where a tongue of said actuator protrudes out from said opening in said housing; said actuator comprising an arm, said tongue configured to be engaged by contact with a keeper, when said actuator is in said extended position, to thereby be driven to pivot to said retracted actuator position, with a side of said arm configured to thereby engage a side of said base projection to be driven centrifugally into contact with a side of said cam stop pin, to cause said end of said cam stop pin to disengage from said side of said base cam stop pin, to permit said cam spring to bias said cam into the extended cam position; and an actuator resilient means, said actuator resilient means configured to normally bias said actuator from the retracted actuator position to the extended actuator position, said arm of said actuator configured to deform to be lifted over a top portion of said base projection during said biased pivotal travel of said actuator from the retracted actuator position to the extended actuator position.

2. The auto cam lock in accordance with claim 1, wherein said housing further comprises a cam stop, said cam stop configured to be engaged by said cam to limit said biased travel of said cam, by said cam resilient means, to its extended position.

3. The auto cam lock in accordance with claim 2, wherein the cam stop element comprises a post.

4. The auto cam lock in accordance with claim 1, wherein said housing further comprises an actuator stop, said actuator stop configured to be engaged by said actuator to limit said biased travel of said actuator, by said actuator resilient means, to its extended position.

5. The auto cam lock in accordance with claim 1, wherein said housing further comprises a base cover and a top cover.

6. The auto cam lock in accordance with claim 5, wherein said top cover is adapted to be partially assembled onto said base cover in a semi-assembled state and to be fully assembled onto said base cover in a final-assembled state, said semi-assembled state being relatively easy to be disassembled and said final-assembled state being relatively difficult to be disassembled.

7. The auto cam lock in accordance with claim 6, wherein the top cover and the base cover respectively comprise a hole and a post, said post configured to be inserted into said hole when said top cover and said base cover are in the semi-assembled state.

8. The auto cam lock in accordance with claim 6, wherein said top cover further comprises a hook and said bottom cover comprises a recess, said hook on said top cover configured to be received within said recess in the bottom cover when said top cover and said base cover are in the final assembled state.

9. The auto cam lock in accordance with claim 1, wherein the auto cam lock further comprises an indicating means for indicating the locked and unlocked states of the auto cam lock.

10. The auto cam lock in accordance with claim 1, further comprising a handle resilient means, said handle resilient means configured to bias said handle member from a first position to a second position.

11. A sash lock comprising:

a housing, said housing configured to mount to a sash window, said housing comprising a cavity, said housing comprising a base cam stop pin and a base projection protruding into said cavity;

a handle member, said handle member comprising a shaft configured to be pivotally received within a hole in said housing, said shaft comprising a projection configured to extend outward from said shaft into said housing cavity;

a cam, said cam configured to pivot about an axis within said housing cavity between a retracted position, and an extended position where a portion of said cam protrudes out from an opening in said housing, said cam comprising a groove in the top of said protruding portion, said cam comprising a hole concentric with said cam pivot axis, said hole configured to pivotally receive said shaft of said handle member, said cam comprising a handle guide slot in the top of said cam, being substantially concentric with said cam pivot axis, said handle guide slot configured to receive said projection of said shaft with said projection being movable therein, said cam thereby configured to be driven from the extended cam position to the retracted cam position by contact between said shaft projection and an end of said handle guide slot; said cam comprising a cam stop pin, an end of said cam stop pin configured to engage a side of said base cam stop pin to releasably retain said cam in the retracted cam position;

a cam spring, said cam spring configured to normally bias said cam to rotate from the retracted cam position to the extended cam position;

an actuator, said actuator configured to pivot about an axis within said housing cavity between a retracted position, and an extended position where a tongue of said actuator protrudes out from said opening in said housing; said actuator comprising an arm, said tongue configured to be engaged by contact with a keeper, when said actuator is in said extended position, to thereby be driven to pivot to said retracted actuator position, with a side of said arm configured to thereby engage a side of said base projection to be driven centrifugally into contact with a side of said cam stop pin, to cause said end of said cam stop pin to disengage from said side of said base cam stop pin, to permit said cam spring to bias said cam into the extended cam position; and an actuator spring, said actuator spring configured to normally bias said actuator to rotate from the retracted actuator position to the extended actuator position, said arm of said actuator configured to deform to be lifted over a top portion of said base projection during said biased pivotal travel of said actuator from the retracted actuator position to the extended actuator position.

12. The sash lock according to claim 11, wherein said handle member occupies a first position when said cam is in said extended cam position, and said handle member is moved into a second position for said driven cam motion into said retracted cam position; and wherein said sash lock comprises a handle member spring, said handle member spring configured to bias said handle to normally pivot from said second handle position to said first handle position.

13. The sash lock according to claim 12, wherein said handle member spring comprises a helical torsion spring terminating in a first end comprising a first hook, and terminating in a second end comprising a second hook; said helix of said handle spring configured to mount to said shaft of said handle, with said first hook configured to be connected to said handle member, and said second hook configured to be connected to said housing.

14. The sash lock according to claim 13, wherein said cam comprises a shaft protruding from a top of said cam, and wherein said cam spring comprises a helical torsion spring terminating in a first end comprising a first hook and terminating in a second end comprising a base hook; said helix of said cam spring configured to mount to said shaft of said cam, with said first cam hook configured to be connected to said cam, and said second cam hook configured to be connected to said housing.

15. The sash lock according to claim 14, wherein said actuator spring comprises a helical torsion spring terminating in a first end comprising a hook and terminating in a second end extending away from said helix; said helix of said actuator spring configured to mount within an opening in said actuator, with said hook of said actuator spring configured to be connected to said actuator, and said second end of said actuator spring configured to contact said housing.

16. The sash lock according to claim 15, wherein said housing comprises a housing base and a housing top cover, said housing top cover configured to be mated with said housing base;

wherein said housing base comprises a bottom wall, with a peripheral wall extending away from a portion of said bottom wall to form the housing cavity, said peripheral wall comprising one or more mating holes, said housing base comprising one or more orifices configured to receive a corresponding mechanical screw to mount said sash lock; an outer surface of said peripheral wall comprising one or more recesses; and wherein said housing top cover comprises a top portion, and a side portion extending away from said top portion; said top portion comprising one or more mating posts configured to be received within said one or more mating holes of said peripheral wall of said housing base; said side portion comprising an inner surface with one or more protrusions protruding therefrom and being configured to be received within said one or more recesses in said peripheral wall of said base, when said housing top cover is mated with said housing base.

17. The sash lock according to claim 16, wherein said cam being configured to pivot within said housing cavity comprises:

a hollow cylindrical boss protruding up from a bottom wall of said housing into the housing cavity, with a concentric hole in said cylindrical boss, and with a first broached opening and a second broached opening extending outward from said hole to form a double keyway;

a cylindrical opening in a bottom of said cam configured to pivotally receive said hollow cylindrical boss of said housing, with a shaft protruding from said cylindrical opening in said cam bottom, and with a pair of keyed projections extending outward from said cam shaft; and wherein said shaft in said cam bottom is configured to be received within said hole in said cylindrical boss of said housing, and wherein said pair of keyed projections of said shaft in said cam bottom are configured to be received through said first and second broached openings in said cylindrical boss of said housing; said pair of keyed projections of said shaft of said cam bottom thereby configured to retain said cam in said pivotal relation with said housing during said pivoting between said cam retracted position and said cam extended position.

18. The sash lock according to claim 17, wherein said cam being configured to pivot within said housing cavity comprises:

an actuator post protruding up from said bottom wall of said housing base; and an orifice in said actuator configured to be pivotally received upon said actuator post of said bottom wall.

19. The sash lock according to claim 18, wherein said hole in said housing for said pivotal mounting of said shaft member comprises a hole in said housing top cover, said hole in said housing top cover further comprising a broached opening extending outward from said hole to form a keyway, and wherein said shaft and said projection of said handle member are configured to be received through said keyway in said housing top cover with said projection of said shaft of said handle member thereby configured to retain said handle member in said pivotal relation with said housing during said pivoting between said first handle position and said second handle position.

20. The sash lock according to claim 15, said cam further comprising an arcuate indicating arm and said housing comprising an indicator window; said arcuate indicator arm of said cam comprising a first color on a first portion of said arm, and a second color on a second portion of said arm; said first color on said first portion of said indicator arm configured to appear in said indicator window of said housing to indicate said cam occupying said cam retracted position, and said second color on said second portion of said indicator arm configured to appear in said indicator window of said housing to indicate said cam occupying said cam extended position.

* * * * *